US007644686B2

(12) United States Patent
Threatt et al.

(10) Patent No.: US 7,644,686 B2
(45) Date of Patent: Jan. 12, 2010

(54) WATER HEATING DISTRIBUTION SYSTEM

(75) Inventors: Gary S. Threatt, Kershaw, SC (US); Howard C. Holliman, Clarksville, TN (US); Robert E. Olson, Milton, WA (US); David L. Stricker, Kent, WA (US)

(73) Assignee: AOS Holding Company, Wilmington, DE (US)

( * ) Notice: Subject to any disclaimer, the term of this patent is extended or adjusted under 35 U.S.C. 154(b) by 588 days.

(21) Appl. No.: 11/458,495

(22) Filed: Jul. 19, 2006

(65) Prior Publication Data

US 2008/0017724 A1 Jan. 24, 2008

(51) Int. Cl.
*F22B 33/02* (2006.01)

(52) U.S. Cl. ..... 122/37; 122/83; 122/33; 237/8 B; 392/454

(58) Field of Classification Search ..... 122/19.1, 122/20 R, 37, 33, 83; 237/7, 8 R, 8 B, 19; 392/445, 454

See application file for complete search history.

(56) References Cited

U.S. PATENT DOCUMENTS

| | | | | | |
|---|---|---|---|---|---|
| 1,367,093 | A | * | 2/1921 | Powell | 122/488 |
| 1,717,207 | A | | 6/1929 | Halle | |
| 2,048,393 | A | * | 7/1936 | Kroger | 122/37 |
| 2,478,836 | A | * | 8/1949 | Riley | 392/461 |
| 2,823,649 | A | | 2/1958 | Flynn | |
| 2,834,865 | A | * | 5/1958 | Coates | 392/450 |
| 3,316,894 | A | * | 5/1967 | Ramey et al. | 122/19.1 |
| 3,351,130 | A | | 11/1967 | Lowe | |
| 3,437,078 | A | * | 4/1969 | Olson | 122/37 |
| 3,933,129 | A | * | 1/1976 | van den Broek | 122/156 |
| 4,438,728 | A | * | 3/1984 | Fracaro | 122/18.31 |
| 4,469,935 | A | | 9/1984 | Candela | |
| 4,598,694 | A | | 7/1986 | Cromer | |
| 4,632,065 | A | | 12/1986 | Kale | |
| 5,076,494 | A | * | 12/1991 | Ripka | 237/19 |
| 5,115,491 | A | | 5/1992 | Perlman et al. | |
| 5,159,918 | A | | 11/1992 | Roehl | |
| 5,433,379 | A | | 7/1995 | Harrison | |
| 5,687,908 | A | | 11/1997 | Talbert et al. | |
| 5,765,546 | A | | 6/1998 | Mandeville et al. | |
| 5,898,818 | A | | 4/1999 | Chen | |
| 6,280,688 | B1 | * | 8/2001 | Motz | 422/68.1 |
| 6,292,628 | B1 | | 9/2001 | Khalaf | |
| 2002/0117122 | A1 | | 8/2002 | Lindner | |

* cited by examiner

*Primary Examiner*—Gregory A Wilson
(74) *Attorney, Agent, or Firm*—Michael Best & Friedrich LLP

(57) ABSTRACT

A water heating apparatus including a tank divided into first and second chambers, wherein water in the first and second chambers has first and second temperatures, respectively, a first outlet for supplying water from the first chamber, a first thermostat to measure the first temperature, a second thermostat to measure the second temperature, means for heating water in the second chamber, a pump having a pump inlet in fluid communication with the second chamber and a pump outlet in fluid communication with the first chamber, and a controller configured to initiate pumping of water from the second chamber to the first chamber when the first temperature is below a predetermined first value. The controller is also configured to initiate heating of water in the second chamber when the second temperature is below a predetermined second value, the second value being greater than the first value.

28 Claims, 4 Drawing Sheets

WATER HEATING DISTRIBUTION SYSTEM

BACKGROUND

The present invention relates to heating water and maintaining water at two different temperatures in a single tank.

SUMMARY

In one embodiment, the invention provides a water heating apparatus including a tank divided into first and second chambers, wherein water in the first chamber has a first temperature and water in the second chamber has a second temperature. The water heating apparatus also includes a first outlet for supplying water from the first chamber to a first recipient, a first thermostat configured to measure the first temperature, a second thermostat configured to measure the second temperature, means for heating water in the second chamber, a pump having a pump inlet in fluid communication with the second chamber and a pump outlet in fluid communication with the first chamber, and a controller configured to initiate pumping of water from the second chamber to the first chamber when the first thermostat indicates the first temperature is below a predetermined first value. The controller is also configured to initiate heating of water in the second chamber when the second thermostat indicates the second temperature is below a predetermined second value, the second value being greater than the first value.

In another embodiment the invention provides a water heating and distribution system including a tank divided into first and second chambers, wherein water in the first chamber has a first temperature and water in the second chamber has a second temperature. The water heating and distribution system also includes a first outlet, a first recipient for receiving water from the first chamber via the first outlet, a first thermostat configured to measure the first temperature, a second thermostat configured to measure the second temperature, means for heating water in the second chamber, a pump having a pump inlet in fluid communication with the second chamber and a pump outlet in fluid communication with the first chamber, and a controller configured to initiate pumping of water from the second chamber to the first chamber when the first thermostat indicates the first temperature is below a predetermined first value. The controller is also configured to initiate heating of water in the second chamber when the second thermostat indicates the second temperature is below a predetermined second value, the second value being greater than the first value.

In another embodiment the invention provides a method of storing water at two temperatures, the method including providing a tank divided into first and second chambers, storing water in the first chamber at a first temperature, storing water in the second chamber at a second temperature, and heating water in the second chamber when the second temperature is below a predetermined second value. The method also includes pumping water from the second chamber to the first chamber when the first temperature is below a predetermined first value, the first values being less than the second value, and permitting water flow from the first chamber to the second chamber while pumping water from the second chamber to the first chamber.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
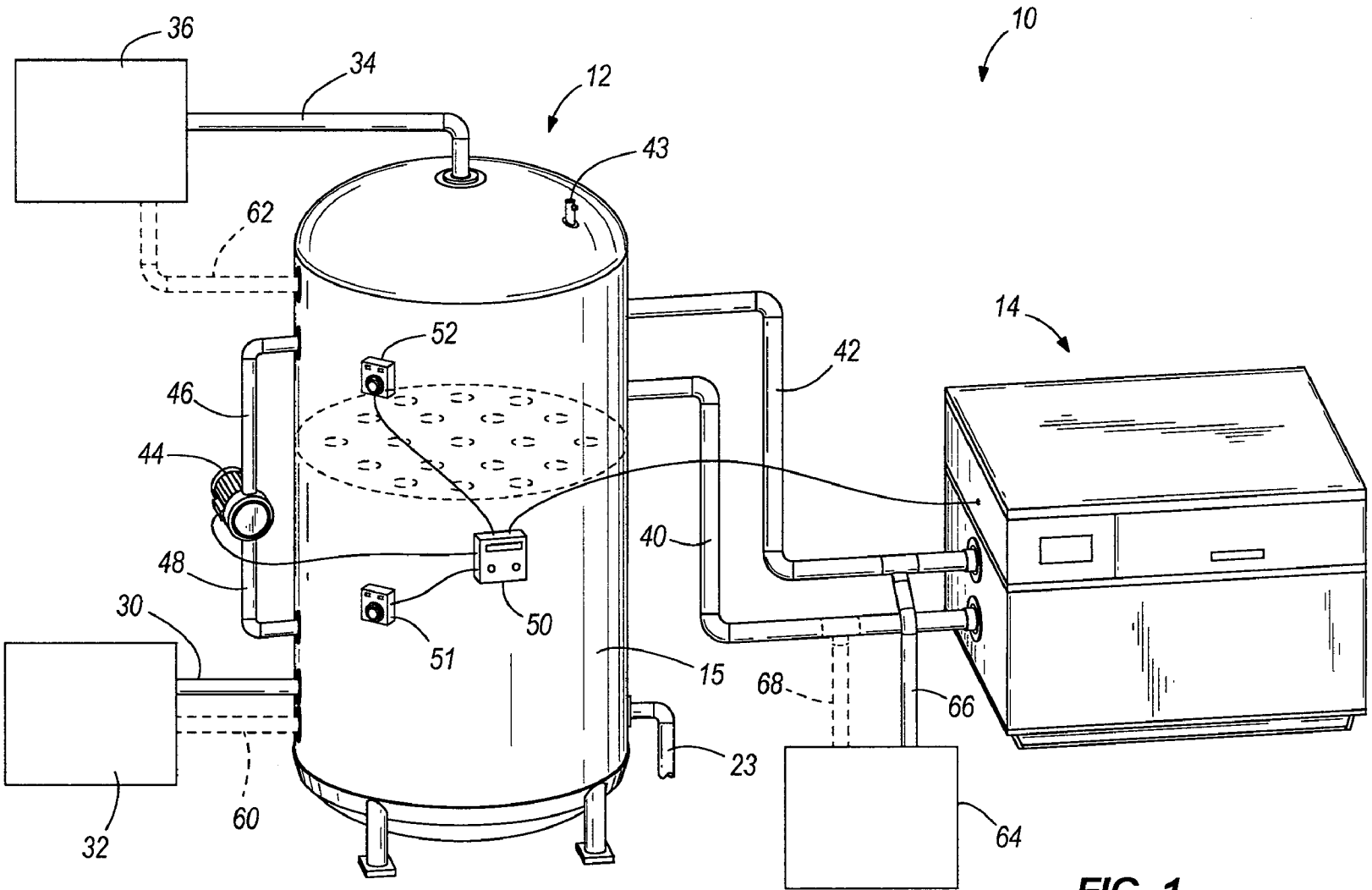
FIG. 1 is a perspective view of a water heating and distribution system embodying the present invention.
Figure 2:
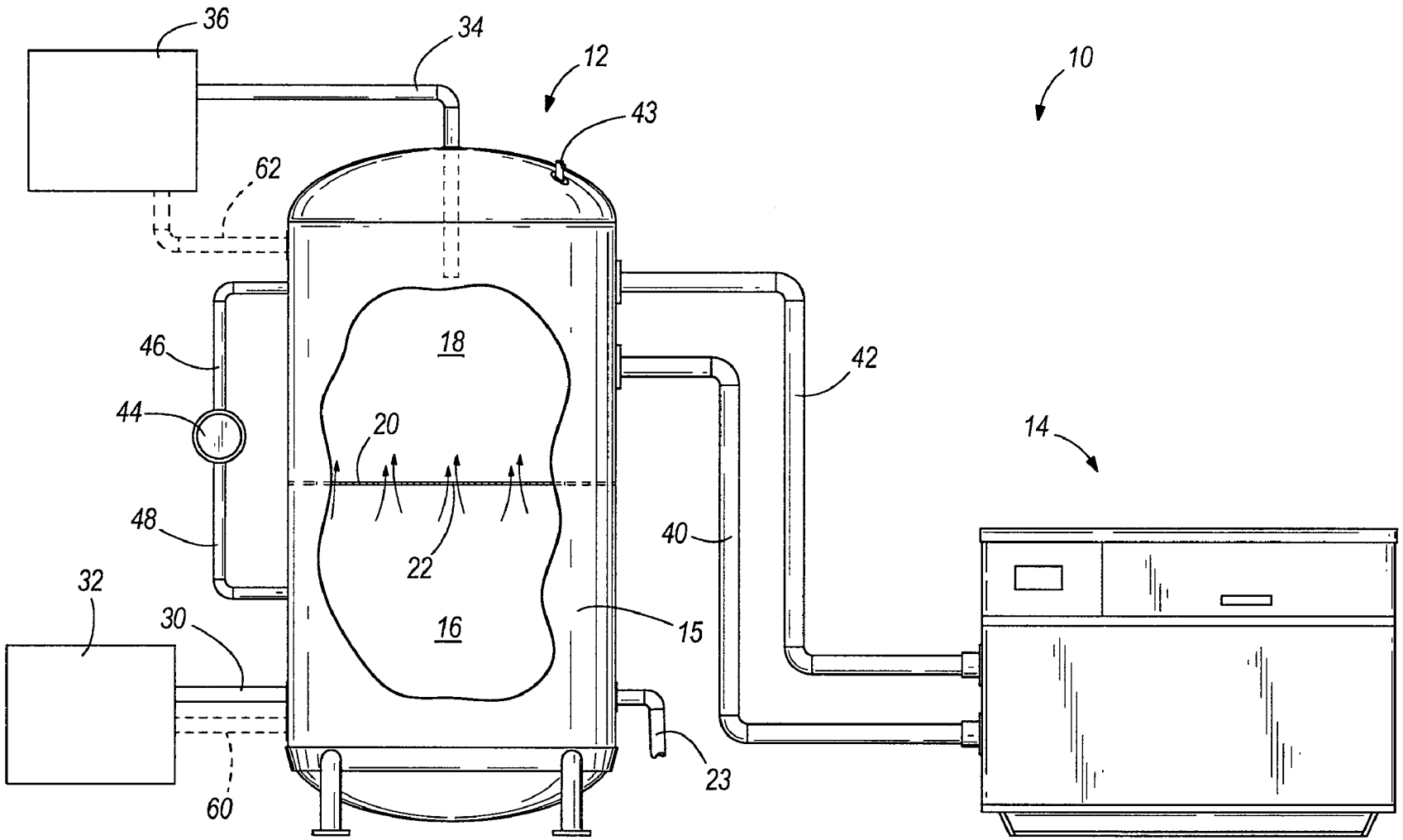
FIG. 2 is a partial cross-sectional view of the water heating and distribution system of FIG. 1.

FIGS. 1 and 2 illustrate a water heating and distribution system 10 embodying the present invention. The water heating apparatus 10 includes a tank 12 and a boiler 14 for heating water in the tank 12. The tank 12 is defined in part by a generally cylindrical tank wall 15 that is preferably insulated to retain heat, and is divided into a first or lower chamber 16 and a second or upper chamber 18 by a baffle 20. The baffle 20 is sealingly connected to the inner surface of the tank 12 about the perimeter of the baffle 20. The baffle 20 is secured within the tank in a substantially horizontal configuration and is substantially flat. The baffle 20 also includes a plurality of apertures that permit fluid communication between the lower and upper chambers 16, 18. A cold water inlet 23 supplies water to the lower chamber 16. In some embodiments, the cold water inlet 23 could supply water to the upper chamber 18.

The tank 12 also includes a first or lower outlet conduit 30 for supplying water from the lower chamber 16, and includes a second or upper outlet conduit 34 for supplying water from the upper chamber 18. First and second recipients 32, 36 receive water via the lower and upper conduits 30, 34, respectively, which is explained in greater detail below. Water can be drawn from either or both of the first and second outlet conduits 30, 34 independently.

In the illustrated embodiment, the boiler 14 is configured to receive water from the upper chamber 18 via a boiler inlet conduit 40, heat the water, and return the heated water to the upper chamber 18 via a boiler outlet conduit 42. As explained in greater detail below, the boiler 14 only heats water in the upper chamber 18 when necessary. In alternative embodiments, the water in the tank 12 can be heated with an electric heating element positioned inside the tank, with a gas burner such as those found on conventional gas water heaters, by a conventional water heater, or by any other suitable means. The tank 12 includes a relief valve 43 near the top of the tank 12 to relieve excess pressure that may build within the tank 12 when water is heated.

A pump 44 is connected to the upper chamber 18 via a pump inlet conduit 46, and is connected to the lower chamber 16 via a pump outlet conduit 48. The pump 44 transfers hot water from the upper chamber 18 to the lower chamber 16.

Figure 3:
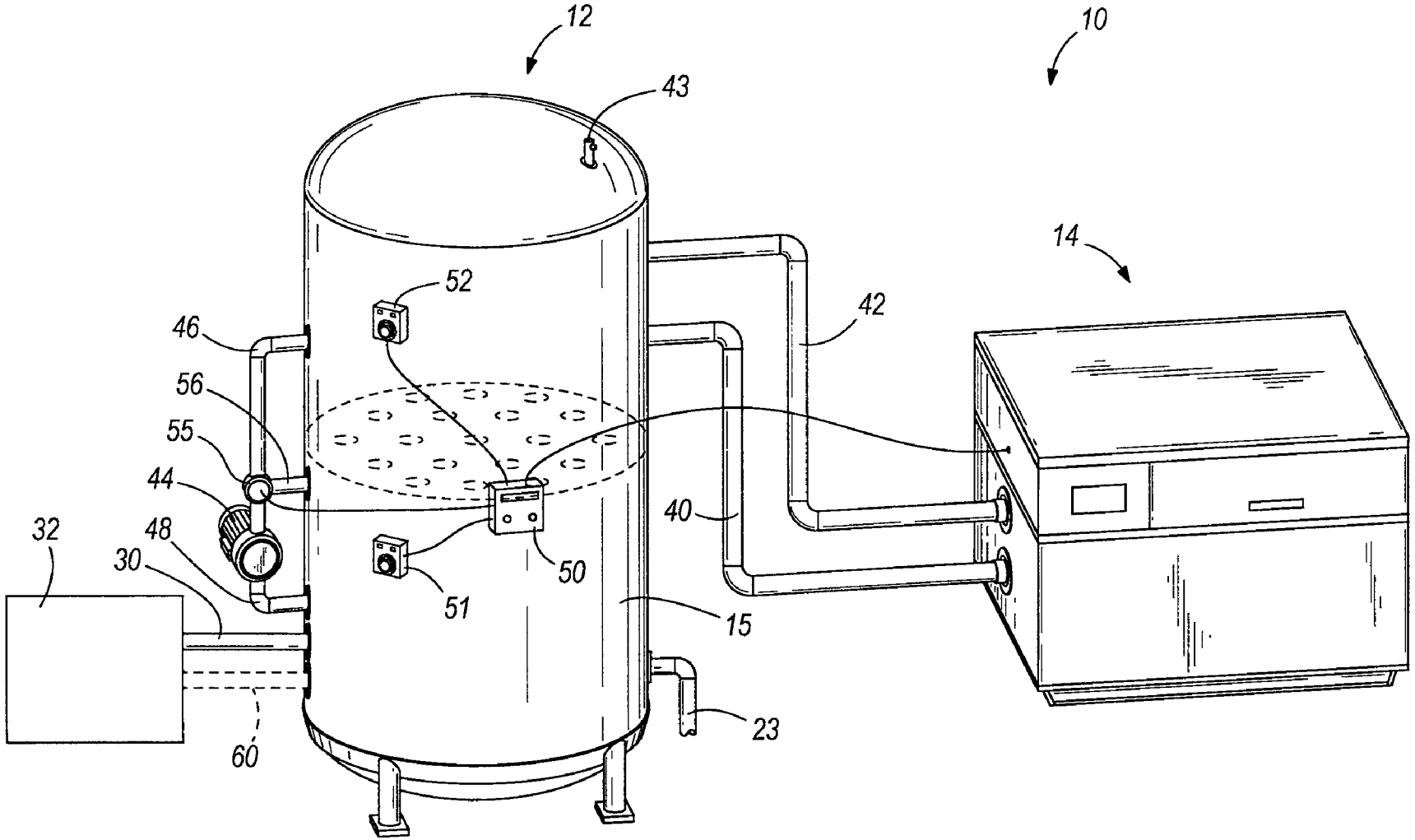
FIG. 3 is a perspective view of a water heating and distribution system that is an alternative embodiment of the present invention.

In the illustrated embodiment of FIGS. 1-3, a controller 50 is employed to control the heating of water in the upper chamber 18 and the pumping of water from the upper chamber 18 to the lower chamber 16. The controller 50 maintains water in the lower and upper chambers 16, 18 at first and second temperatures, respectively. In the illustrated embodiment, the second temperature is greater than the first temperature. The controller 50 is connected to first and second thermostats 51, 52. The first and second thermostats 51, 52 are connected to the tank 12 to measure the first and second temperatures, respectively. The controller 50 is also connected to the boiler 14 and the pump 44. First and second values defining desired first and second temperatures are assigned to the first and second thermostats 51, 52, respectively. The controller 50 monitors the first and second temperatures with the first and second thermostats 51, 52, and controls heating and pumping as described below to maintain the first and second temperatures at the first and second values.

When the second thermostat 52 indicates the second temperature has dropped below the assigned second value, the controller 50 sends a signal to the boiler 14 to cycle and heat water in the upper chamber 18. When the second temperature has met the second value, the controller 50 sends a signal to the boiler 14 to cease cycling and heating.

When the first thermostat 51 indicates the first temperature has dropped below the assigned first value, the controller 50 sends a signal to the pump 44 to transfer warmer water from the upper chamber 18 to the lower chamber 16. When water is pumped from the upper chamber 18 to the lower chamber 16, water from the lower chamber 16 flows through the apertures in the baffle 20 into the upper chamber 18. When the first temperature has met the first value, the controller 50 sends a signal to the pump 44 to cease pumping.

In some embodiments, it may be more economical to operate the pump 44 continuously, rather than turn it on and off as required. In these embodiments, a control valve 55 may be included in the pump inlet conduit 46 (see FIG. 3) and connected to the controller 50. The control valve 55 can allow water to be pumped from the upper chamber 18 to the lower chamber 16 as described above, or can alternatively allow water to be drawn from the lower chamber 16 via conduit 56 and pumped back into the lower chamber 16 to circulate or stir water in the lower chamber 16. Instead of turning the pump 44 on and off, the controller 50 can actuate the control valve 55 to determine whether water from the upper or lower chamber 18, 16 is supplied to the pump 44, depending on the temperature requirements at that instant.

The heating of water in the upper chamber 18 and the pumping of water from the upper chamber 18 to the lower chamber 16 occur independently. To minimize wasted energy, the controller 50 only activates the boiler 14 or the pump 44 when necessary. The controller 50 is preferably configured to have some tolerance to avoid constantly turning the boiler 14 and pump 44 on and off. For example, if the assigned first value is 140 F for the lower chamber 16, the controller 50 may pump water from the upper chamber 18 into the lower chamber 16 until the first temperature reaches 142 F before turning off the pump 44, and also may not turn the pump 44 on until the first temperature falls to 138 F. A similar principle could be applied to the upper chamber 18 and the boiler 14. These values are only an example, and could be varied to minimize actuation of the boiler 14 and pump 44 while keeping the first and second temperatures within suitable ranges, depending on the requirements of the first and second recipients 32, 36.

When water is drawn from the first outlet conduit 30, replacement water fills the lower chamber 16 from the cold water inlet. When water is drawn from the second outlet conduit 34, replacement water enters the upper chamber 18 through the apertures in the baffle 20 from the lower chamber 16, and replacement water fills the lower chamber 16 from the cold water inlet. The controller 50 is constantly monitoring the first and second temperatures and controlling heating and pumping to maintain the first and second temperatures, even when water is being drawn from either or both of the lower and upper chambers 16, 18.

The water heating apparatus 10 can be used in numerous applications, including potable water systems and hydronic heating systems. FIGS. 1 and 2 illustrate a first application where potable water at a first temperature is required by the first recipient 32, and potable water at a second, higher temperature is required by the second recipient 36. An example of this type of application is a commercial kitchen where water at approximately 140 F, for example, is maintained in the lower chamber 16 and is intended for general purpose use, while water at approximately 180 F, for example, is maintained in the upper chamber 18 and is used by dishwashers and other sanitary applications.

FIGS. 1 and 2 also illustrate the water heating apparatus 10 configured for use in a hydronic heating application. In this embodiment, the tank 12 includes a first inlet conduit 60 for supplying return water from the first recipient 32 to the lower chamber 16, and includes a second inlet conduit 62 for supplying return water from the second recipient 36 to the upper chamber 18. In this embodiment, the first and second recipients 32, 36 are first and second hydronic heating systems, respectively, wherein the first and second hydronic heating systems require water at different temperatures.

The water heating apparatus 10 as illustrated in FIGS. 1 and 2 can also be used in alternative embodiment to supply water to three recipients at three temperatures. This embodiment assumes that a third recipient 64 requires hot water directly from the boiler 14, the second recipient 36 requires water at a lower temperature than the third recipient 64, and the first recipient 32 requires water at a lower temperature than the second recipient 36. In this embodiment, a third outlet conduit 66 is configured to supply water from the boiler 14 to the third recipient 64. Water is maintained at the desired first and second temperatures in the upper and lower chambers 18, 16 as described above. In the event that the third recipient 64 is a hydronic heating system, a third inlet conduit 68 supplies water from the third recipient 64 to the boiler inlet conduit 40.

FIG. 3 illustrates an embodiment of the water heating and distribution system 10 where the tank 12 includes only the first outlet conduit 30 in the lower chamber 16 rather than first and second outlet conduits 30, 34. This embodiment is configured to supply water to only the first recipient 32, and assumes that the first recipient 32 requires water at a lower temperature than the boiler 14 can output while operating in an efficient manner. This embodiment is convenient if the first recipient requires water at 140 F, for example, and the boiler 14 is configured to output water at 180 F, for example. In operation, water enters the upper chamber 18 from the boiler 14 at 180 F, while water in the lower chamber 16 is maintained at 140 F as described above with respect to the embodiment illustrated in FIGS. 1 and 2. This allows the first recipient 32 to receive water at the desired temperature of 140 F, and allows the boiler 14 to operate in a temperature range for which it was intended.

Also illustrated in FIG. 3 is an embodiment where the first recipient 32 is a hydronic heating system that requires water at a lower temperature than what the boiler 14 is configured to output. Similar to the embodiment illustrated in FIGS. 1 and 2, the tank also includes a first inlet 60 for supplying return water from the first recipient 32 to the lower chamber 16.

In the illustrated embodiments in FIGS. 1-3, the tank 12 includes first and second outlet conduits 30, 34 and first and second inlet conduits 60, 62. In some of the described embodiments, the tank 12 is lacking one or more inlet and/or outlet conduit. To lower manufacturing costs, the tank 12 is manufactured with the capacity to include both outlet conduits 30, 34 and both inlet conduits 60, 62. In the event that an operator wishes to use the tank as described in the embodiments requiring less inlets and/or outlets, or change the manner in which the tank 12 is used, a plug may be applied to the tank 12 to replace the inlet and/or outlet conduits that will not be used. This allows a single tank to be manufactured that will satisfy a number of different applications.

Figure 4:
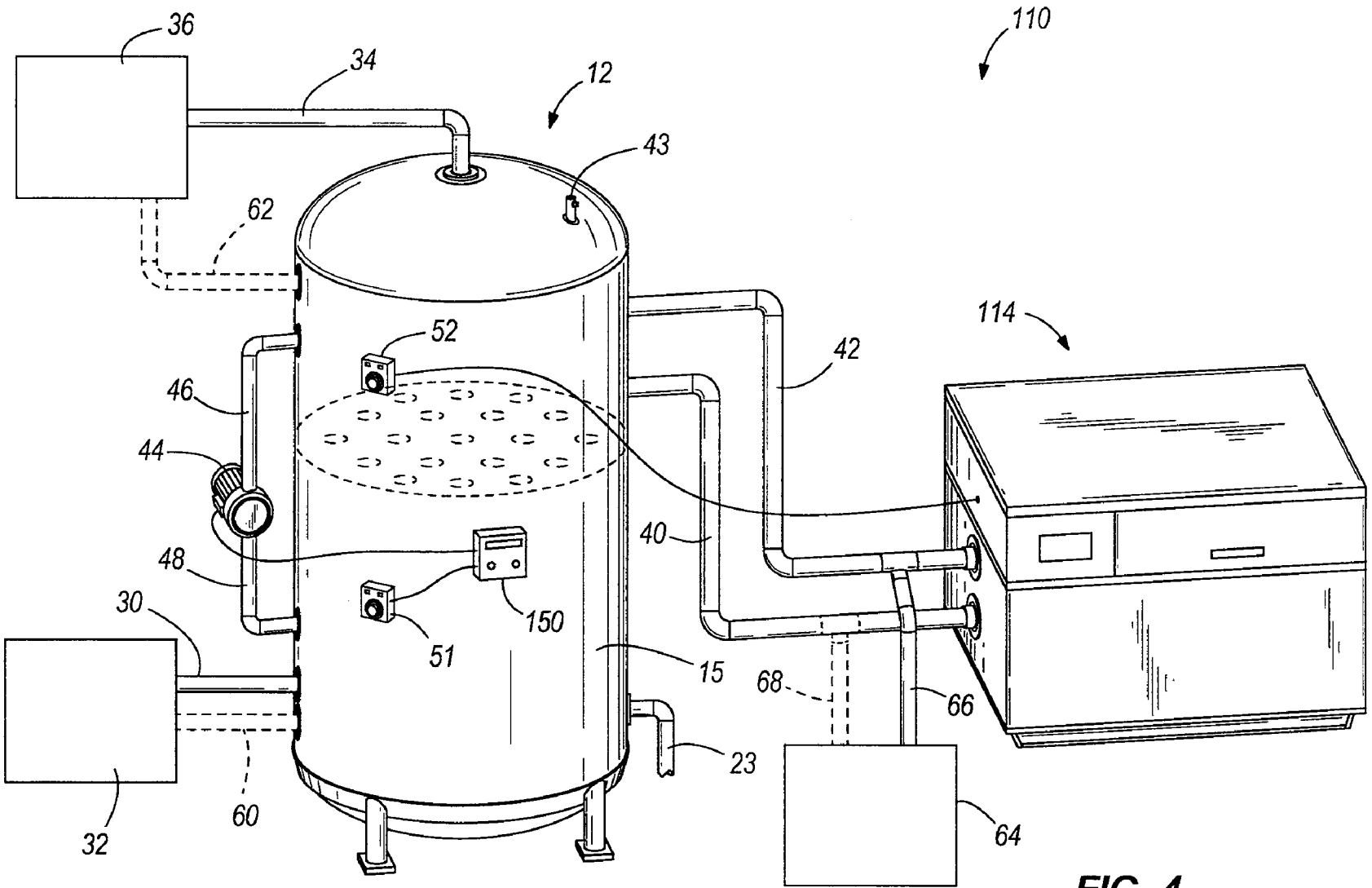
FIG. 4 is a perspective view of a water heating and distribution system that is an alternative embodiment of the present invention.

FIG. 4 illustrates another embodiment of a water heating and distribution system 110 according to the present invention. The water heating and distribution system 110 shown in FIG. 4 is similar in many ways to the illustrated embodiments of FIGS. 1-3 described above. Accordingly, with the exception of mutually inconsistent features and elements between the embodiment of FIG. 4 and the embodiments of FIGS. 1-3, reference is hereby made to the description above accompanying the embodiments of FIGS. 1-3 for a more complete description of the features and elements (and the alternatives to the features and elements) of the embodiment of FIG. 4.

FIG. 4 illustrates the controller 150 connected to the first thermostat 51 and the pump 44. The second thermostat 52 is connected to the boiler 114. Similar to the embodiments of FIGS. 1-3, the controller 150 is employed to control the pumping of water from the upper chamber 18 to the lower chamber 16 when the first thermostat 51 indicates the first temperature has dropped below the assigned first value. In embodiments where the pump 44 is configured to operate continuously, the controller 150 is connected to the control valve 55 (as shown in FIG. 3) and actuates the control valve 55 to determine whether water from the upper or lower chamber 18, 16 is supplied to the pump 44, depending on the temperature requirements in the lower chamber 16 at that instant.

In the illustrated embodiment of FIG. 4, the boiler 114 is not controlled by the controller 150. Rather, the boiler 114 is configured to monitor the temperature of the water in the upper chamber 18 and heat the water in the upper chamber 18 when the second thermostat 52 indicates the second temperature has dropped below the assigned second value. When the second temperature has met the second value, the boiler 114 ceases cycling and heating of water from the upper chamber 18.

What is claimed is:

1. A water heating apparatus comprising:

a tank divided into first and second chambers; wherein water in the first chamber has a first temperature and water in the second chamber has a second temperature;

a first outlet for supplying water from the first chamber to a first recipient;

a first thermostat configured to measure the first temperature;

a second thermostat configured to measure the second temperature;

means for heating water in the second chamber;

a pump having a pump inlet in fluid communication with the second chamber and a pump outlet in fluid communication with the first chamber; and a controller configured to initiate pumping of water from the second chamber to the first chamber when the first thermostat indicates the first temperature is below a predetermined first value;

the controller also configured to initiate heating of water in the second chamber when the second thermostat indicates the second temperature is below a predetermined second value, the second value being greater than the first value.

2. The water heating apparatus of claim 1, wherein the first chamber is positioned below the second chamber.

3. The water heating apparatus of claim 1, wherein the means for heating water comprises a boiler in communication with the second chamber for receiving water from the second chamber, heating the water from the second chamber, and returning the heated water to the second chamber.

4. The water heating apparatus of claim 1, further comprising a baffle dividing the tank into the first and second chambers, the baffle including an aperture that permits water flow between the first and second chambers.

5. The water heating apparatus of claim 4, wherein the baffle is generally horizontal.

6. The water heating apparatus of claim 4, wherein when water is pumped from the second chamber to the first chamber water flows into the second chamber from the first chamber through the aperture in the baffle.

7. The water heating apparatus of claim 4, further comprising a cold water inlet in the first chamber.

8. The water heating apparatus of claim 7, wherein when water is drawn from the first outlet, cold water flows into the first chamber through the cold water inlet.

9. The water heating apparatus of claim 7, wherein when water is drawn from the second outlet, water flows into the second chamber from the first chamber through the aperture in the baffle and cold water flows into the first chamber through the cold water inlet.

10. The water heating apparatus of claim 1, further comprising a second outlet for supplying water from the second chamber to a second recipient.

11. The water heating apparatus of claim 10, wherein water may be drawn from the first and second outlets independently.

12. A water heating and distribution system comprising:

a tank divided into first and second chambers; wherein water in the first chamber has a first temperature and water in the second chamber has a second temperature;

a first outlet;

a first recipient for receiving water from the first chamber via the first outlet;

a first thermostat configured to measure the first temperature;

a second thermostat configured to measure the second temperature;

means for heating water in the second chamber;

a pump having a pump inlet in fluid communication with the second chamber and a pump outlet in fluid communication with the first chamber; and a controller configured to initiate pumping of water from the second chamber to the first chamber when the first thermostat indicates the first temperature is below a predetermined first value;

the controller also configured to initiate heating of water in the second chamber when the second thermostat indicates the second temperature is below a predetermined second value, the second value being greater than the first value.

13. The water heating and distribution system of claim 12, wherein the first recipient is a potable water system.

14. The water heating and distribution system of claim 12, wherein the first recipient is a hydronic heating system.

15. The water heating and distribution system of claim 14, further comprising a first inlet to receive water from the first recipient in the first chamber.

16. The water heating and distribution system of claim 12, further comprising a second outlet for supplying water from the second chamber to a second recipient.

17. The water heating and distribution system of claim 16, wherein at least one of the first and second recipients is a potable water system.

18. The water heating and distribution system of claim 16, wherein the first and second recipients are first and second hydronic heating systems.

19. The water heating and distribution system of claim 18, further comprising a first inlet to receive water from the first recipient in the first chamber, and a second inlet to receive water from the second recipient in the second chamber.

20. The water heating and distribution system of claim 12, wherein the first chamber is positioned below the second chamber.

21. The water heating and distribution system of claim 12, wherein the means for heating water comprises a boiler in communication with the second chamber for receiving water from the second chamber, heating the water from the second chamber, and returning the heated water to the second chamber.

22. The water heating and distribution system of claim 12, further comprising a baffle dividing the tank into the first and second chambers, the baffle including an aperture that permits water flow between the first and second chambers.

23. The water heating and distribution system of claim 22, wherein the baffle is generally horizontal.

24. The water heating and distribution system of claim 22, wherein when water is pumped from the second chamber to the first chamber water flows into the second chamber from the first chamber through the aperture in the baffle.

25. The water heating and distribution system of claim 22, further comprising a cold water inlet in the first chamber.

26. The water heating and distribution system of claim 25, wherein when water is drawn from the first outlet, cold water flows into the first chamber through the cold water inlet.

27. The water heating and distribution system of claim 25, wherein when water is drawn from the second outlet, water flows into the second chamber from the first chamber through the aperture in the baffle and cold water flows into the first chamber through the cold water inlet.

28. The water heating and distribution system of claim 25, wherein water may be drawn from the first and second outlets independently.

* * * * *

UNITED STATES PATENT AND TRADEMARK OFFICE

CERTIFICATE OF CORRECTION

PATENT NO. : 7,644,686 B2
APPLICATION NO. : 11/458495
DATED : January 12, 2010
INVENTOR(S) : Threatt et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 765 days.

Signed and Sealed this

Sixteenth Day of November, 2010

David J. Kappos

David J. Kappos
*Director of the United States Patent and Trademark Office*